United States Patent [19]

Konrad et al.

[11] Patent Number: 5,042,231

[45] Date of Patent: Aug. 27, 1991

[54] END FLAP ALIGNMENT DEVICE FOR CARTON FOLDING AND FILLING APPARATUS AND METHOD OF FOLDING CARTON END FLAPS

[75] Inventors: Kenneth Konrad, Kalamazoo, Mich.; Todd Ruhbusch, Onalaska, Wis.

[73] Assignee: James River Corporation, Richmond, Va.

[21] Appl. No.: 471,744

[22] Filed: Jan. 29, 1990

Related U.S. Application Data

[63] Continuation-in-part of Ser. No. 324,667, Mar. 17, 1989, Pat. No. 4,907,698.

[51] Int. Cl.[5] ..... B65B 3/02

[52] U.S. Cl. ..... 53/458; 53/376.5; 53/377.2; 53/382.2; 53/491; 493/183

[58] Field of Search ..... 53/374, 491, 458, 564, 53/383, 387, 382.2, 382.3, 383.1, 376.5, 376.4, 377.4, 377.2, 387.2, 492; 493/183, 453

[56] References Cited

U.S. PATENT DOCUMENTS

| | | | |
|---|---|---|---|
| 2,612,016 | 9/1952 | Anderson | 53/56 |
| 2,832,270 | 4/1958 | Pierce et al. . | |
| 3,206,915 | 9/1965 | Anderson et al. | 53/374 |
| 3,219,257 | 11/1965 | Anderson | 229/51 |
| 3,261,536 | 7/1966 | Bixler | 229/37 |
| 3,741,082 | 6/1973 | Sorensen et al. . | |
| 4,471,601 | 9/1984 | Strombeck | 53/383 X |
| 4,526,563 | 7/1985 | Froom | 493/151 |
| 4,569,182 | 2/1986 | Leuvering | 53/456 |
| 4,587,792 | 5/1986 | Hartness et al. | 493/183 X |

*Primary Examiner*—James F. Coan

*Attorney, Agent, or Firm*—Finnegan, Henderson, Farabow, Garrett & Dunner

[57] ABSTRACT

An apparatus for folding and filling a plurality of cartons erected from a plurality of collapsed carton tubes includes an end flap alignment device attached to the conveying and folding mechanism of the apparatus. The end flap alignment device folds one of the bottom end flaps of the collapsed carton tube inwardly and in the same motion folds the top end flap which is also provided on the bottom of the carton tube outwardly so that the bottom end flap and the top end flap are aligned in the same plane. The end flap alignment device comprises a generally U-shaped fork comprising a base attached to a plate and two rods each connected at one end thereof to the base. The plate is attached to a reciprocable slide of the apparatus by a pivot rod. One end of the pivot rod is connected to a cam, which rides in a cam track. As the slide is reciprocated, the plate, including fork, is pivoted about the pivot rod. By this motion, the fork aligns the bottom end flap and the top end flap of the bottom of the carton tube in the same plane so that glue may be applied thereto in one motion.

12 Claims, 7 Drawing Sheets

END FLAP ALIGNMENT DEVICE FOR CARTON FOLDING AND FILLING APPARATUS AND METHOD OF FOLDING CARTON END FLAPS

The present application is a continuation-in-part of U.S. patent application Ser. No. 07/324,667, filed Mar. 17, 1989, now U.S. Pat. No. 4,907,698.

II. BACKGROUND OF THE INVENTION

A. Field of the Invention

The present invention relates to an end flap alignment device for a carton folding and filling apparatus and a method of folding the carton end flaps of a carton.

B. Description of the Prior Art

Machines for folding and filling cartons are known in the packaging art. Typically, such a machine automatically sets up a flattened carton blank, fills it with ice cream or other material, and then closes the carton. These steps are performed in sequential fashion in response to the carton being filled to the desired degree. One type of folding and filling machine is known as an Anderson Model 555 machine, or simply an Anderson machine, and is disclosed in U.S. Pat. No. 2,612,016. U.S. Pat. Nos. 3,206,915 and 3,219,257 are directed to modifications of the Anderson machine disclosed in the '016 patent.

Due to the large number of carton flaps which must be folded and glued, such a machine requires a complex arrangement of parts and a multiplicity of manufacturing steps. In particular, the application of glue to carton flaps disposed in relatively transverse planes markedly complicates the problem of adhesively sealing the ends of the carton. It is therefore desirable to align the carton flaps in the same plane to enable glue to be applied thereto in the same motion, thereby reducing the number of steps and thus the cost involved in folding and sealing a carton.

III. SUMMARY OF THE INVENTION

In summary, then, the present invention provides a distinct advantage to a dairy or other filling location in the form of an attachment to an existing carton folding and filling machine. The attachment enables a simple flap folding and gluing sequence by aligning the bottom end flap and the top end flap of the bottom of the carton such that they are aligned in the same plane before the folding sequence of the bottom of the carton. With this arrangement, glue may be applied thereto in the same motion. This flap folding and gluing sequence results in a more efficient and economical operation of the dairy or other filling location.

In addition, it is an object of the present invention to provide an attachment which is readily adaptable to a known folding and filling apparatus, such as an Anderson Model 555 machine, with relatively little labor or cost to the carton manufacturer. Advantageously, the attachment may be readily removed to convert the modified folding and filling apparatus back to a conventional Anderson machine.

Another object of the invention is to provide an attachment to a known carton folding and filling apparatus which is of simple construction, has a minimum number of parts, and will operate continuously and consistently with a minimum of service trouble.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises an attachment for an apparatus for folding and filling a plurality of cartons erected from a plurality of collapsed carton tubes, each carton tube including: (A) a receptacle portion having opposite ends and including front, bottom, rear and top panels hingedly connected to each other in the order stated; (B) first and second bottom end flaps hingedly connected to the bottom panel; and (C) first and second top end flaps hingedly connected to the top panel; the attachment comprising end flap alignment means for folding in the first bottom end flap and in the same motion folding out the first top end flap such that the first bottom end flap and the first top end flap are aligned in the same plane.

It is to be understood that both the foregoing general description and the following detailed description are exemplary and explanatory only and are not restrictive of the invention as claimed.

IV. BRIEF DESCRIPTION OF THE DRAWINGS

The accompanying drawings, which are incorporated in and constitute a part of this specification, illustrate one embodiment of the invention and, together with the description, serve to explain the principles of the invention.

V. DESCRIPTION OF THE PREFERRED EMBODIMENT

Reference will now be made in detail to the present preferred embodiment of the invention, an example of which is illustrated in the accompanying drawings. Wherever possible, the same reference numbers will be used throughout the drawings to refer to the same or like parts.

Figure 1:
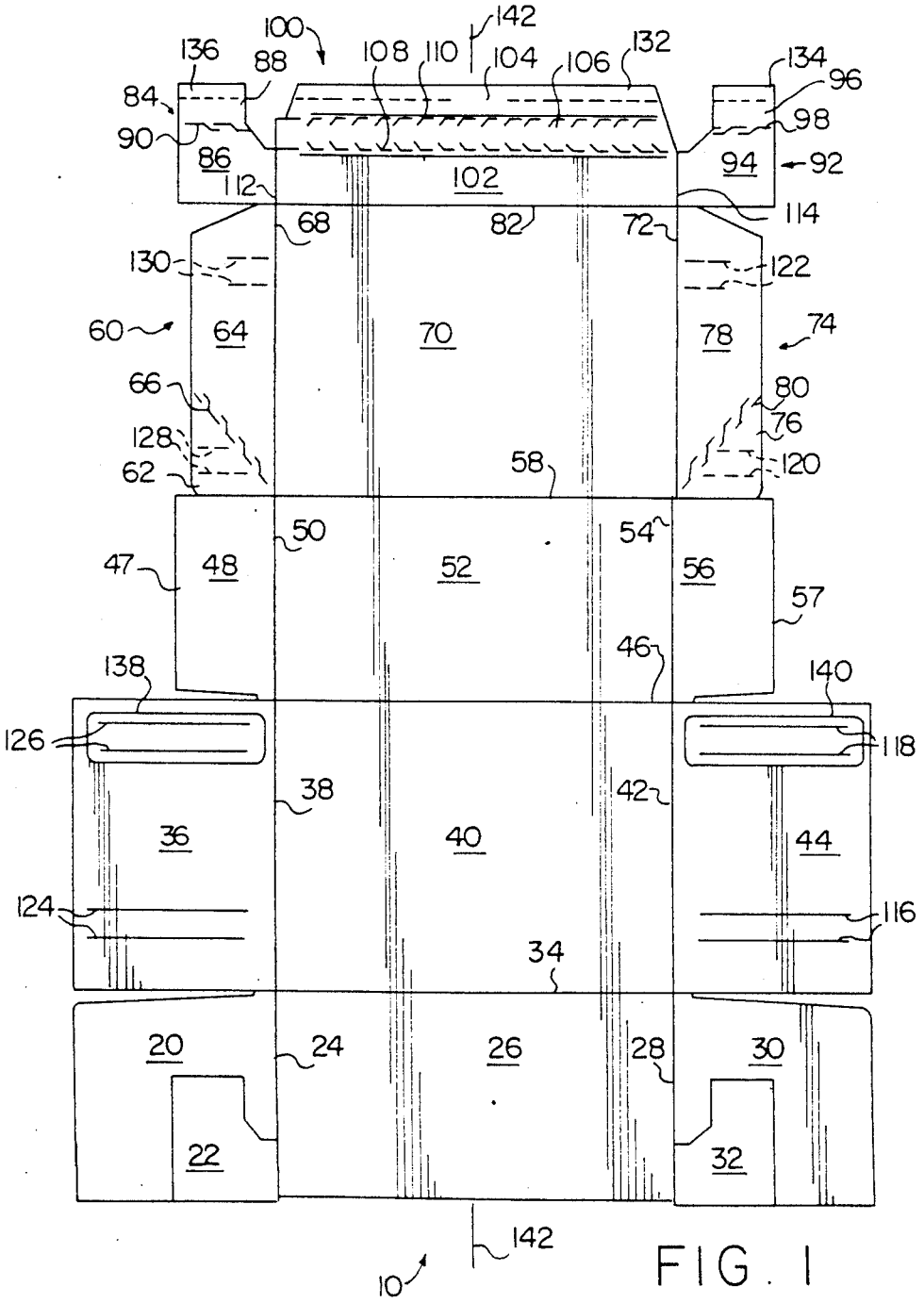
FIG. 1 is a plan view of a carton blank having a first bottom end flap which is folded in and a first top end flap which is folded out by the end flap alignment device of the present invention.

A carton blank having end flaps which are folded by the end flap alignment device of the present invention is shown generally at 10 in FIG. 1. The flaps on the right-hand side of FIG. 1 form the bottom, or first side, of a finished folded and sealed carton and the flaps on the left-hand side of FIG. 1 form the top, or second side, of the carton.

Carton blank 10 includes front panel 26, bottom panel 40, rear panel 52, and top cover panel 70. These panels are hingedly connected to each other in the order stated by score lines 34, 46 and 58, respectively.

Hingedly connected to front panel 26 along score line 28 is first front end flap 30 having an indented debossed portion 32. Hingedly connected to front panel 26 along score line 24 is second front end flap 20 having an indented debossed portion 22. Indented portions 22 and 32 are adapted to receive first and second corner post flaps 92 and 84, respectively.

Hingedly connected to bottom panel 40 along score line 42 is first bottom end flap 44. Hingedly connected to bottom panel 40 along score line 38 is second bottom end flap 36. Hingedly connected to rear panel 52 along score line 54 is first rear end flap 56. Hingedly connected to rear panel 52 along score line 50 is second rear end flap 48.

Second bottom end flap 36 includes embossed or raised portion 138, and first bottom end flap 44 includes embossed or raised portion 140. Raised portions 138, 140 preferably do not extend beyond edges 47 and 57 when first and second rear end flaps 56 and 48, respectively, are folded into position. Raised portions 138, 140 are provided with adhesive strips 126, 118, respectively, onto which glue is provided. Raised portions 138, 140 are urged into adhesive contact with first and second rear end flaps 56, 48 for bonding flaps 56, 48 to first and second bottom end flaps 44, 36, respectively.

Hingedly connected to top cover panel 70 along score line 72 is first top end flap 74 which includes first adhesive tab 76 and first end cover skirt 78 separated from each other by severance line 80. Hingedly connected to top cover panel 70 along score line 68 is second top end flap 60 which includes second adhesive tab 62 and second end cover skirt 64 separated from each other by severance line 66.

Hingedly connected to top cover panel 70 along score line 82 is front cover sealing flap 100, which includes front cover skirt 102 and adhesive tab 104 separated from each other by tear strip 106 which is defined by severance lines 108 and 110. Hingedly connected to front cover skirt 102 of front cover sealing flap 100 along score line 114 is first corner post flap 92 which includes first corner hood tab 94 and first adhesive tab 96 separated from each other by severance line 98. Hingedly connected to front cover skirt 102 of front cover sealing flap 100 along score line 112 is second corner post flap 84 which includes second corner hood tab 86 and second adhesive tab 88 separated from each other by severance line 90.

Figure 2:
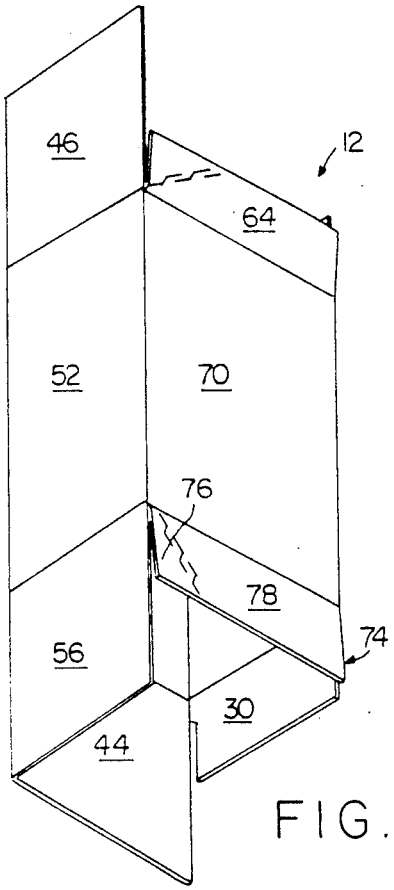
FIG. 2 is a perspective view of carton tube which has been erected or squared up.

FIG. 2 shows a carton tube 12 which has been squared or erected for closure of one end and for receiving ice cream or another product such as fluid semi-solid mass to be packaged. When carton blank 10 is folded along score lines 46 and 82 to form a collapsed carton tube 12, front cover sealing flap 100 is sealed to front panel 26 by adhesive strip 132, onto which glue is applied. Also, first and second corner post flaps 92, 84 overlie indented portions, 32, 22 and first and second adhesive tabs 96, 88 are adhesively connected to first and second front end flaps 30, 20 by first and second adhesive strips 134, 136, respectively, onto which glue is applied. Preferably adhesive strips 132, 134 and 136 are applied to adhesive tabs 104, 96, and 88, respectively.

Figure 3:
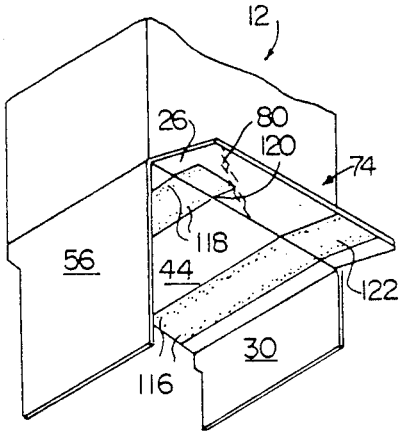
FIG. 3 is a fragmentary perspective view of the carton tube of FIG. 2 showing the first bottom end flap folded in, the first top end flap folded out, and adhesive strips applied.

The flap folding sequence for the first flaps, i.e., the flaps which form the bottom of the carton tube, will now be described with respect to FIGS. 3-5. After squaring carton tube 12, first bottom end flap 44 is lifted and folded in towards the center of the carton tube to close the major end opening of the carton tube by end flap alignment means, shown at 300 in FIGS. 8-11. In the same motion, first top end flap 74 is folded out, i.e., away from first bottom end flap 44, so that first bottom end flap 44 and first top end flap 74 are aligned in the same plane as illustrated in FIG. 3. First adhesive strips 116 and 118, onto which glue is applied, are preferably parallel to each other and are adhered to first bottom end flap 44. First adhesive strip 120, onto which glue is also applied, is adhered to first adhesive tab 76. First adhesive strip 122, onto which glue is also applied, is adhered to first end cover skirt 78.

Figure 4:
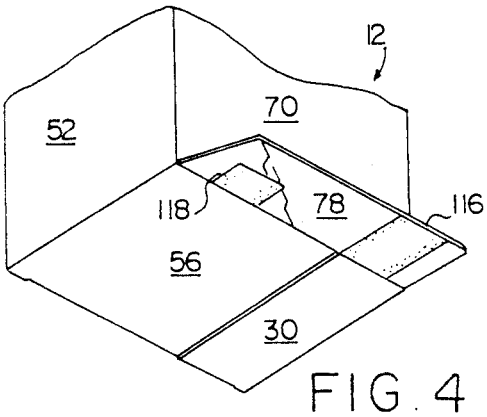
FIG. 4 is a perspective view of the carton tube of FIG. 3 showing the first front end flap folded in and the first rear end flap folded in and overlying the first front end flap.
Figure 5:
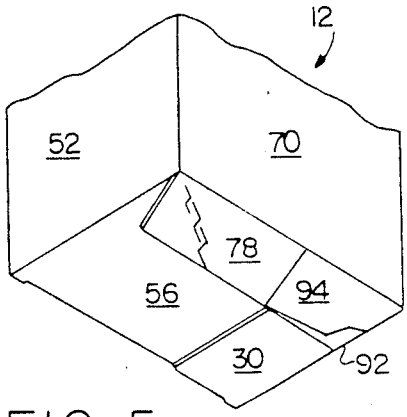
FIG. 5 is a perspective view of the carton tube in FIG. 4 showing the first top end flap folded in, forming a carton.

As shown in FIG. 4, first rear end flap 56 is folded in to contact first adhesive strip 118 for adhesively connecting first rear end flap 56 to first bottom end flap 44. Then, first front end flap 30 is folded into contact first adhesive strip 116 for adhesively connecting front end flap 30 to first bottom end flap 44, and at the same time, corner post flap 92 is then folded into position along with front end flap 30. Next, first top end flap 74 is folded in for adhesively connecting first top end flap 74 to first corner post flap 92 and first rear end flap 56, thus closing and sealing the first end, or bottom, of the assembled carton tube as illustrated in FIG. 5.

The folding and filling apparatus which folds carton blank 10 as shown in FIG. 1 into carton tube 12 as shown in FIGS. 2-5 and fills this tube will now be described in detail in conjunction with FIGS. 6 and 7. As discussed above, this type of apparatus is known in the art. Several embodiments of this apparatus are disclosed in U.S. Pat. Nos. 2,612,016, 3,206,915 and 3,219,257, which are incorporated herein by reference.

Figure 6:
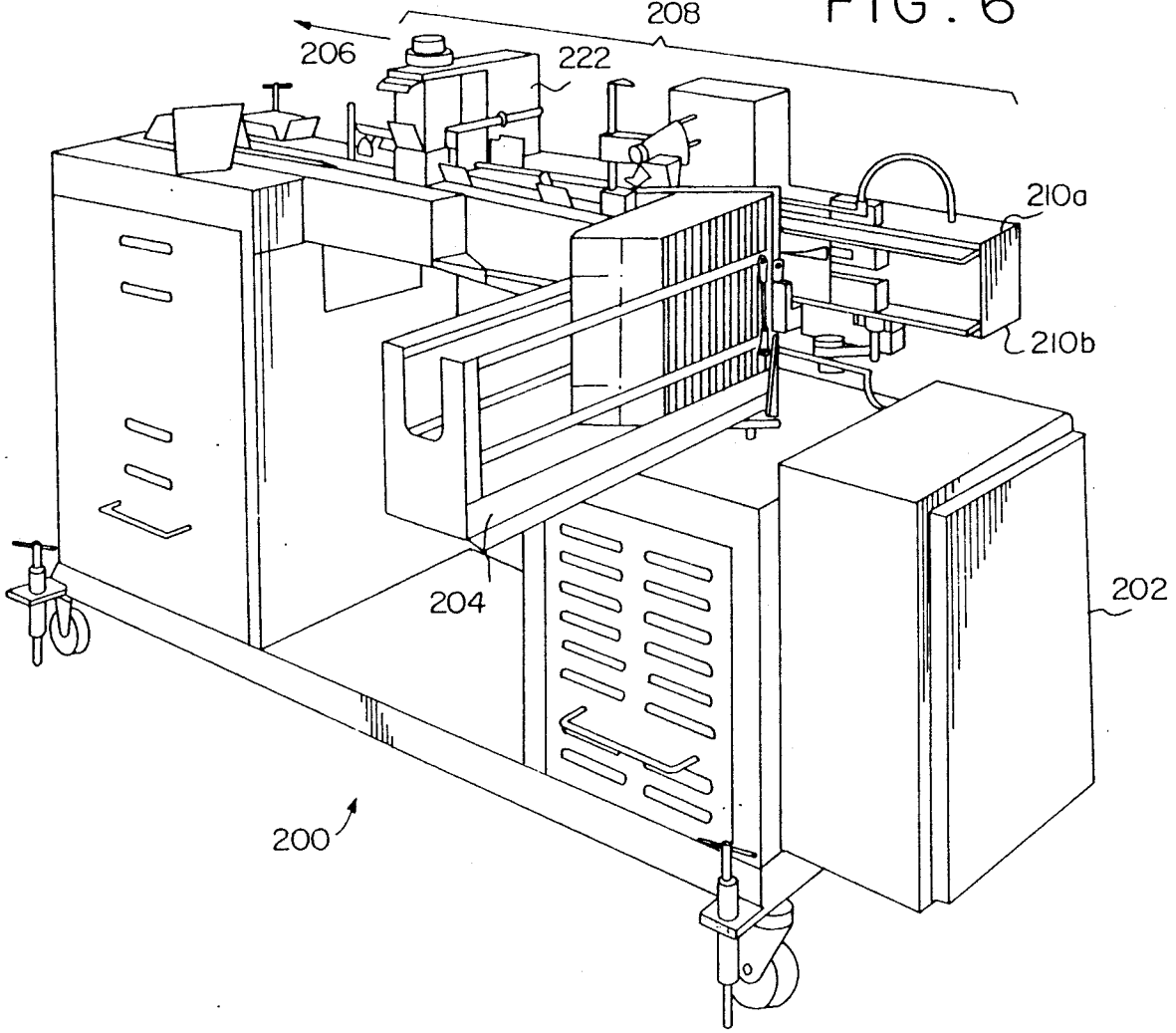
FIG. 6 is a perspective view of the front of a conventional folding and filling apparatus.
Figure 7:
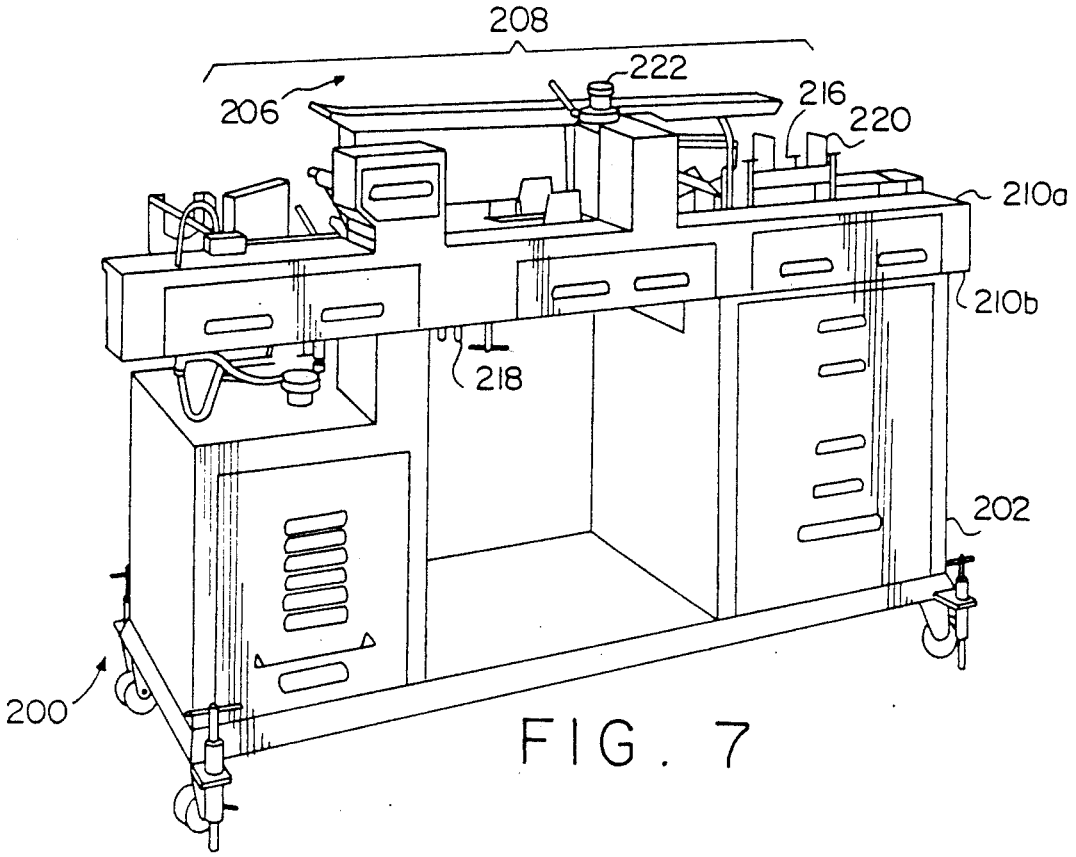
FIG. 7 is a perspective view of the back of a folding and filling apparatus shown in FIG. 6.

A conventional folding and filling apparatus is shown generally at 200 in FIGS. 6 and 7. Folding and filling apparatus 200 is disposed on a base 202 and includes a stacking and feeding mechanism 204. Carton stacking and feeding mechanism 204 comprises a plurality of solenoid actuated suction cups which grasp the stacked carton tubes to feed them into the carton folding and filling apparatus. The carton tubes are fed, one by one, in a direction of travel indicated by arrow 206 to a carton conveying and folding mechanism, shown generally at 208 in FIGS. 6 and 7. Conveying and folding mechanism 208 is driven by a drive mechanism which is disposed in base 202. The drive mechanism is activated at the start of a production cycle by a switch.

Figure 10:
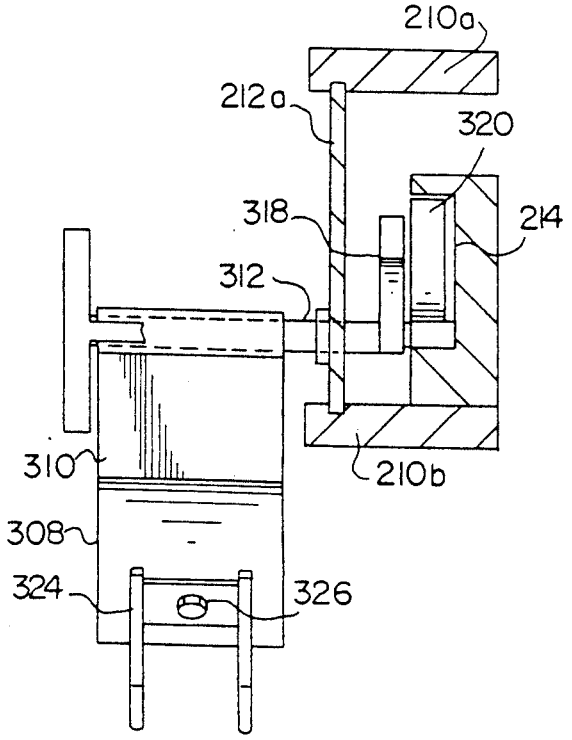
FIG. 10 is a partial, cross-sectional view of a section of the apparatus shown in FIG. 8.
Figure 9:
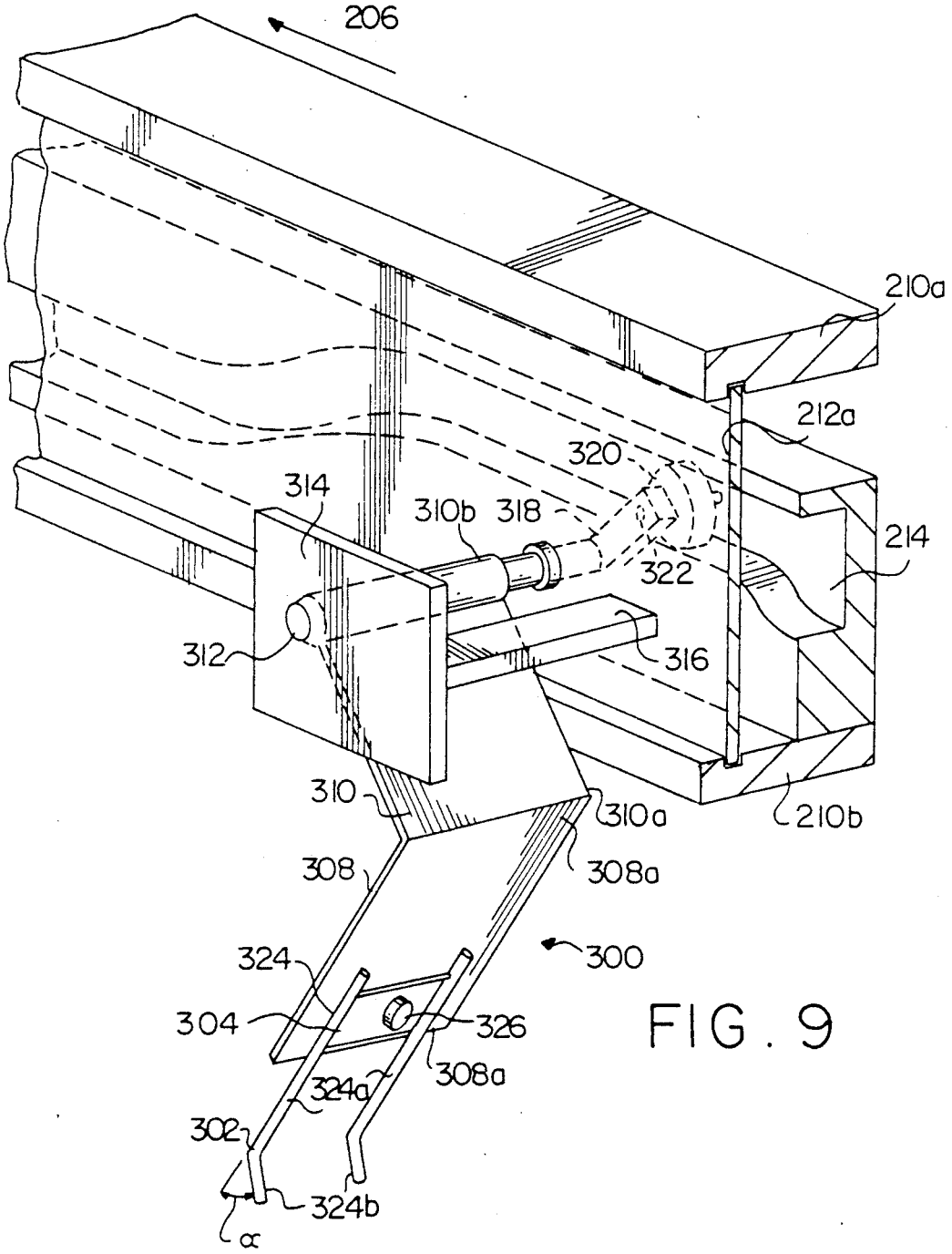
FIG. 9 is an enlarged, perspective view of one embodiment of the end flap alignment device of the present invention in the rest position thereof, showing its connection to the apparatus of FIG. 8.
Figure 11:
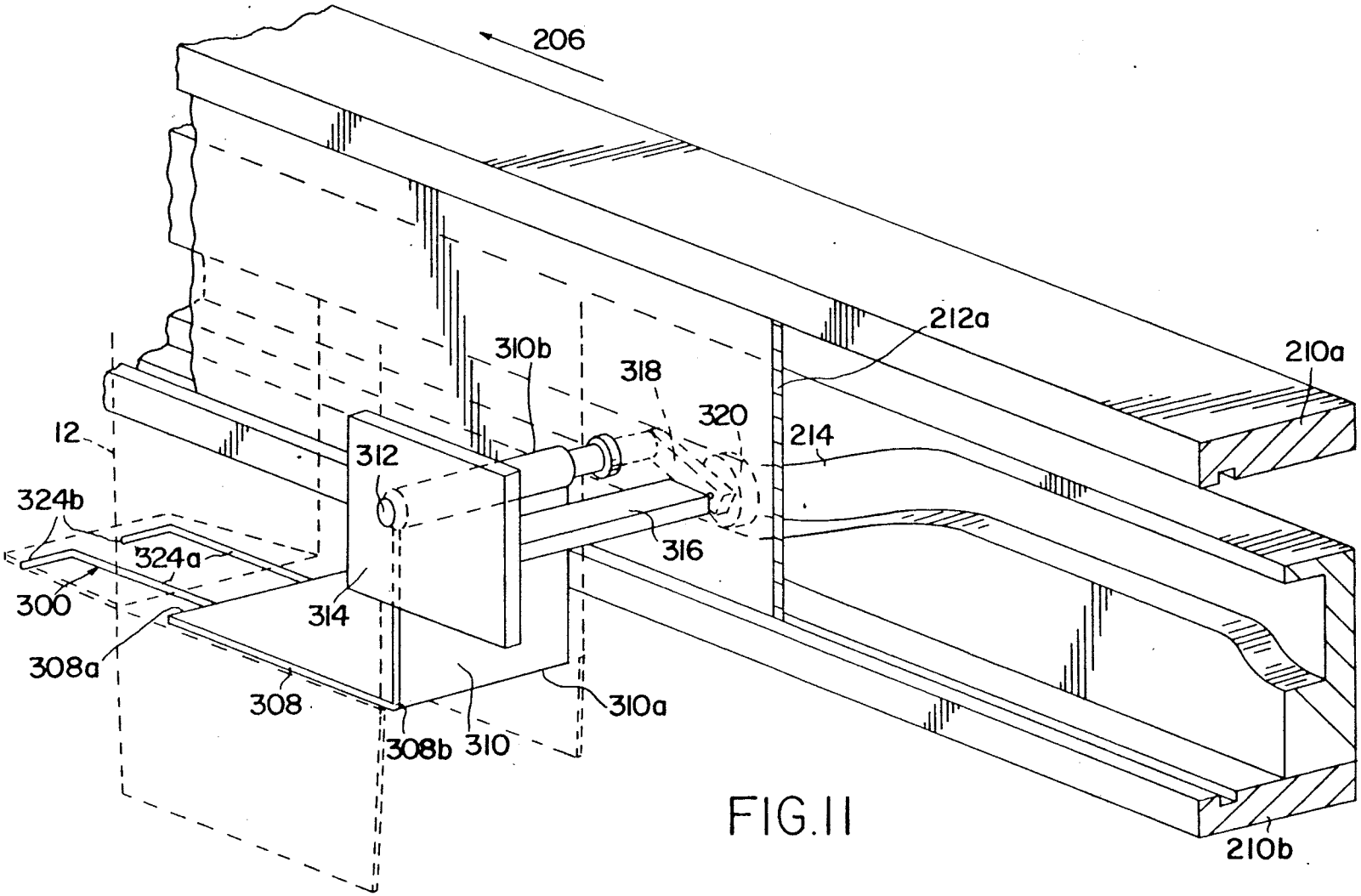
FIG. 11 is a perspective view of the end flap alignment device of the present invention at the end of its path of travel.

Carton conveying and folding mechanism 208 includes rails 210*a*, 210*b*, the inner, opposed surfaces of which are formed with pairs of grooves extending the entire length of each rail. Each of the grooves has a slide 212*a*, 212*b* (only slide 212*a* is shown in FIGS. 9–11) reciprocably mounted therein. Slides 212*a*, 212*b* extend substantially the length of the rails 210*a*, 210*b* in the direction of travel of the collapsed carton tubes 12. The inner lower surface of rails 210*a*, 210*b* is configured as a cam track, shown at 214 in FIGS. 9–11. Cam track 214 is configured with an irregular contour.

Slides 212*a*, 212*b* are reciprocated forward and backward with one another. Carton tubes 12 are held between slides 212*a*, 212*b* and extend in the vertical direction above and below rails 210*a*, 210*b*. As the slides are reciprocated, carton tubes 12 held therebetween are conveyed in the direction of arrow 206 along the rails from an upstream position to a downstream position.

Conveying and folding mechanism 208 further comprises a plurality of blades, which are not shown as they are disposed between rails 210*a*, 210*b* of FIGS. 6 and 7. The blades convey the carton tubes along rails 210*a*, 210*b* as the slides are reciprocated.

Carton conveying and folding mechanism 208 further comprises a carton erecting mechanism which is disposed along rails 210*a*, 210*b* just upstream of stacking and feeding mechanism 204. The carton erecting mechanism operates to square or erect each collapsed carton tube 12.

Carton conveying and folding mechanism 208 further comprises a first flap folding apparatus and a second flap folding apparatus. The first flap folding apparatus is disposed between rails 210*a*, 210*b* and therefore is not visible in FIGS. 6 and 7, and second flap folding apparatus is shown at 218 in FIG. 7. The first flap folding apparatus folds the flaps which form the bottom of a folded and sealed carton. Second flap folding apparatus 216 is shown in FIG. 7 and folds the flaps which form the top of a folded and sealed carton.

First and second glue devices 218 and 220, respectively, are shown in FIG. 7 and are disposed along rails 210*a*, 210*b* just downstream of the first flap folding apparatus and the second flap folding apparatus. First and second glue devices 218 and 220 apply glue to the bottom and top, respectively, of the carton tubes during the folding sequence of the bottom and top of the carton tubes.

Carton folding and filling apparatus 200 further comprises a filling mechanism 222. Filling mechanism 222 includes a nozzle which discharges a continuous stream of material downwardly into the carton tube and a lifting mechanism for elevating the carton into position around the nozzle.

Figure 8:
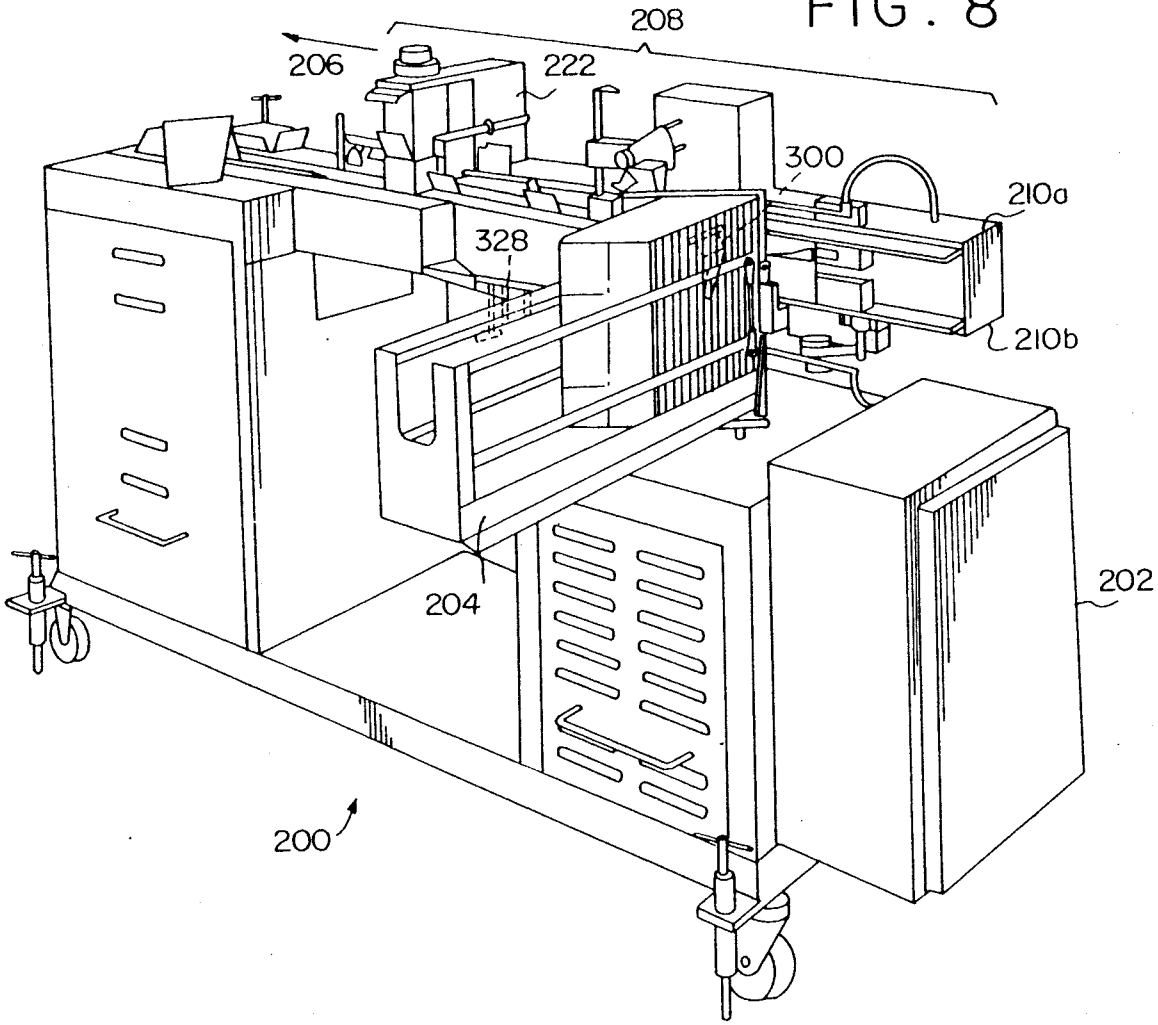
FIG. 8 is a perspective view of the front of a folding and filling apparatus with the end flap alignment device of the present invention attached thereto.

In accordance with the present invention there is provided means for folding the first bottom end flap in and the first top end flap out such that the first bottom end flap and the first top end flap are aligned in the same plane. The end flap alignment means are shown generally at 300 in FIG. 8 attached to a folding and filling apparatus, such as that shown in FIGS. 6 and 7. As seen in FIG. 8, alignment means 300 are attached to conveying and folding mechanism 208 just downstream of stacking and feeding mechanism 204.

As best shown in FIG. 9, alignment means 300 comprises a generally U-shaped fork 302 attached to a plate. The plate comprises a first arm 308 and a second arm 310. Arm 308 extends downwardly toward the floor and arm 310 extends upwardly towards slide 212*a*. Arm 308 has an upper edge 308*a* and a lower edge 308*b*. and arm 310 also has an upper edge 310*a* and a lower edge 310*b*. Arm 308 and arm 310 intersect at upper edge 308*a* and lower edge 310*b*.

Upper edge 310*b* of arm 310 is mounted on a pivot rod 312. Pivot rod 312 preferably comprises a stainless steel rod. Pivot rod 312 extends through slide 212*a* and is rotatably journaled therein by a bushing. One end of pivot rod 312 is rotatably journaled in a bushing in a metal block 314. Metal block 314 is connected to slide 212*a* by a one-piece bar 316 having a T-shaped configuration. As shown in FIG. 9, the other end of pivot rod 312 is attached to a link 318, which is fixed to rod 312 and which is shown by dashed lines behind slide 212*a* in FIGS. 9 and 11. Link 318 is attached to a cam 320 by a pin 322, which are also shown in dash. Pin 322 is fixed to link 318. Preferably, cam 316 comprises a nylon roller. Since pivot rod 312 extends through slide 212*a*, as slide 212*a* is reciprocated, cam 320, which is totally enclosed in cam track 214, rotates along cam track 214. Cam 320 is totally enclosed in cam track 214. At the same time, slide 212*a*, cam 320 and fork 302 move forward in the direction of travel of the carton tubes, as shown by arrow 206. Due to the irregular contour of cam track 214, fork 302 is pivoted upwardly about pivot rod 312 by approximately 45°. This pivotal movement lifts and folds first bottom end flap 44 in, i.e., towards the center of a folded carton tube and first end flap 74 out, i.e., away from the center of a folded carton tube, in the same motion.

As embodied herein, fork 302 comprises a base 304 and a plurality of rods 324, each connected at one end thereof to the base. Rods 324 each comprise a substantially linear portion 324*a* and a substantially angled portion 324*b* connected to linear portion 324*a* which extends upwardly as shown in FIG. 9. Angled portion 324*b* and a part of linear portion 324*a* extend beyond lower edge 308*a* of first arm 308. Preferably, linear portion 324*a* and angled portion 324*b* form an angle $\alpha$ of about 30° as shown in FIG. 9. Preferably, the length of first bottom end flap 44 measured in the direction perpendicular to score line 42 is approximately 3.5 times greater than the combined length of the angled portion and the part of the linear portion which extends from lower edge 308*a* and the length of first top end flap 74 measured in the direction perpendicular to score line 72 is approximately 1.5 times greater than the combined length of the angled portion and the part of the linear portion which extends from lower edge 308*a*. In one example, bottom end flap 44 is 3½ inches in length, top end flap is 1½ inches in length and the combined length of the angled portion and the part of the linear portion which extends from the lower edge of first arm 308 is 1 inch.

Although the end flap alignment means are described above and shown as a U-shaped fork, it will be apparent to those skilled in the art that various modifications and variations can be made in the end flap alignment means of the present invention without departing from the scope or spirit of the invention. For example, the alignment means may comprise more than two rods. Alternatively, the end flap alignment means may comprise a solid piece instead of rods having a space therebetween.

Fork 302 is detachably secured to planar surface 308 by fastening means extending through base 304 of fork 302. Preferably, the fastening means comprises a bolt 326 which is manually adjustable, so that fork 302 of the present invention may be removed to easily convert the carton folding and filling apparatus as shown in FIG. 8, with fork 302 attached thereto, back to a conventional carton folding and filling apparatus. This provides added flexibility in employing the fork of the present invention in a conventional folding and filling apparatus such as an Anderson machine.

The present invention further comprises means for applying glue to the first bottom end flap and the first top end flap in the same motion. The means for applying glue to the first bottom end flap and the first top end flap in the same motion comprise glue apparatus 328 as shown in dash in FIG. 8. Such an apparatus is commercially available and is sold off the shelf under the trademark Nordson. Glue apparatus 328 is controlled by a programmable limit switch, or PLS, which is also commercially available and is sold under the trademark Electro Cam. After first top end flap 74 has been folded out so that it aligned in the same plane as first bottom end flap 44. glue apparatus 328 applies glue to both flaps 44 and 74 in the same motion. With the folding and gluing sequence of the present invention, the steps for applying glue to the bottom of the carton may be reduced, resulting in a reduction in the time and cost of the manufacture of the cartons.

According to the present invention there is provided a method of folding a plurality of cartons erected from a plurality of collapsed carton tubes. The method comprises the step of folding in the first bottom end flap and folding out the first top end flap in the same motion such that the first bottom end flap and the first top end flap are aligned in the same plane. As embodied herein, the method comprises the step of folding in first bottom end flap 44 and in the same motion of the machine folding out first top end flap 74 such that first bottom end flap 44 and first top end flap 74 are aligned in the same plane as shown in FIG. 3.

The method further comprises the step of applying glue to the first bottom end flap and the first top end flap in the same motion of the machine. As embodied herein, the method comprises applying glue to first bottom end flap 44 and to first top end flap 74 in the same motion. Since flaps 44 and 74 have been aligned in the same plane by fork 302 of the present invention, this arrangement enables the application of glue in the same motion. As noted above, this feature of the present invention results in a reduction in the number of manufacturing steps, and thus in the cost of manufacturing cartons.

In operation, it will be understood that a number of cartons will normally be moved serially and in step fashion through the apparatus as shown in FIG. 8. To simplify the description and facilitate an understanding of the operation, however, a single carton will be traced through the machine in the description below.

A stack of collapsed carton tubes 12 is delivered to stacking and feeding mechanism 204. The drive mechanism is actuated to cause slides 212*a*, 212*b* of folding and conveying mechanism 208 to be moved in unison. The first reciprocation of slides 212*a*, 212*b* causes the blades to engage the rear edge of the leading collapsed carton tube to feed the carton tubes into the carton folding and filling apparatus.

By the next reciprocation of the slides, the blades are operated to convey carton tube 12 to the carton erecting mechanism. The carton erecting mechanism squares or erects the collapsed carton tubes into squared carton tubes so that they are configured substantially as shown in FIG. 2.

FIG. 9 shows fork 302 in its rest position, before a carton tube has been delivered to its location along rails 210*a*, 210*b*. As slides 212*a*, 212*b* are reciprocated in the direction of travel of the carton tubes, a carton tube 12 is delivered along rails 210*a*, 210*b* to the location of fork 302. By the reciprocation of the slides, cam 320 rides in cam track 214, which is irregular in configuration, thereby pivoting rod 312. This motion lifts fork 302 upwardly about 45° to the position shown in FIG. 11, folding first bottom end flap 44 in towards the center of carton tube 12 and first top end flap 74 outwardly as shown in FIG. 3, so that flaps 44 and 74 are aligned in the same plane.

Glue apparatus 328 then applies glue to first bottom end flap 44 and first top end flap 74. Since flaps 44 and 74 have been aligned in the same plane as shown in FIG. 3, glue may be applied in the same motion. Then, the first flap folding apparatus folds first front end flap 20 and first rear end flap 56 inwardly as shown in FIG. 4 and folds first top end flap 74 inwardly over flaps 30 and 56 as shown in FIG. 5.

At the next reciprocation of the slides, the blades bring carton tube 12 into close proximity with the carton tube at filling mechanism 222. At the initial forward movement of the next reciprocation of the slides, carton tube 12 is moved to filling mechanism 222. The carton's open top then moves telescopically upward over the mouth of the nozzle. Material such as ice cream flows continuously from nozzle into the carton and the pressure forces the newly introduced carton down until it is filled, at which point it actuates the switch to energize the drive mechanism. This reciprocates slides 212*a*, 212*b* to move the following empty carton tube forward. This forward movement pushes the filled carton tube forward from beneath the nozzle, shearing off the ice cream flush with the carton surface and replacing the filled carton tube immediately with an empty one. As this empty, following carton tube is lifted by the lifting mechanism, the filled carton tube is moved along rails 212*a*, 212*b*.

At the next reciprocation of slides 212*a*, 212*b* the filled carton tube is advanced by the blades past the second flap closing apparatus, where the top of the carton tube is closed. At the next reciprocation of the slides, the closed carton tube is advanced by blades to second glue device 220, which applies glue to the top of the carton during the folding sequence thereof to seal the top of the carton.

Finally, at the next reciprocation of slides 212*a*, 212*b* the carton tube is discharged from the folding and filling apparatus as a closed, sealed and filled carton and is ready for storage or marketing.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An apparatus for folding and filling a plurality of cartons erected from a plurality of collapsed carton tubes, each carton tube including;

(A) a receptacle portion including front, bottom, rear, and top panels foldably connected to each other in the order stated, (B) first and second bottom end flaps foldably connected to the bottom panel, and (C) first and second top end flaps foldably connected to the top panel, the apparatus comprising:

carton folding means for erecting the carton, with the front, bottom, rear, and top panels, second bottom end flap, and second top end flap cooperating to define an open receptacle portion, the first top end flap and first bottom end flap extending in spaced planes;

end flap alignment means adapted to be attached to the apparatus for folding the first bottom end flap toward the open receptacle portion and folding the first top end flap away from the open receptacle portion in the same motion of the apparatus such that the first bottom end flap and the first top end flap are aligned in the same plane; and filling means for filling the open receptacle portion with a selected substance.

2. The apparatus as claimed in claim 1, further comprising means for applying adhesive to the first bottom and flap folded toward the open receptacle portion and the first top end flap folded away from the open receptacle portion in the same motion.

3. An attachment for an apparatus for folding and filling a plurality of cartons erected from a plurality of collapsed carton tubes, each carton tube including (A) a receptacle portion including front, bottom, rear, and top panels foldably connected to each other in the order stated, (B) first and second bottom end flaps foldably connected to the bottom panel, and (C) first and second top end flaps foldably connected to the top panel, the front, bottom, rear, and top panels, second bottom end flap, and second top end flap cooperating to define and open receptacle portion with the first top end flap and first bottom end flap extending in spaced planes at times when the carton is erected, the attachment comprising:

end flap alignment means adapted to be attached to the apparatus for folding the first bottom end flap toward the open receptacle portion and folding the first top end flap away from the open receptacle portion in a single motion such that he first bottom end flap and the first top end flap are aligned in the same plane.

4. The attachment as claimed in claim 1, wherein the end flap alignment means comprises a generally U-shaped fork including a base and a plurality of rods each having a substantially linear portion connected to the base and a substantially angled portion connected to the linear portion.

5. The attachment as claimed in claim 4, wherein the end alignment means is attached to a plate including a first arm and a second arm, each of the first and second arms having an upper edge and a lower edge, respectively, and wherein the first and second arms intersect at the upper edge of the first arm and the lower edge of the second arm.

6. The attachment as claimed in claim 5, wherein the fork is detachably secured to the first arm by fastening means extending through the base.

7. The attachment as claimed in claim 6, wherein the fastening means comprises a bolt.

8. The attachment as claimed in claim 5, wherein the substantially angled portion extends upwardly in the vertical direction.

9. The attachment as claimed in claim 4, wherein the linear portion and the angled portion intersect at an angle of about 30 °.

10. A method of folding a plurality of collapsed carton tubes, each carton tube including (A) a receptacle portion including front, bottom, rear, and top panels foldably connected to each other in the order stated, (B) first and second bottom end flaps foldably connected to the bottom panel, and (C) first and second top end flaps foldably connected to the top panel the front, bottom, rear, and top panels, second bottom end flap, and second top end flap cooperating to define and open receptacle portion with the first top end flap and first bottom end flap extending in spaced planes at times when the carton is erected, the method comprising the step of:

folding the first bottom end flap toward the open receptacle portion and in the same motion folding the first top end flap away from the open receptacle portion such that the first bottom end flap and the first top end flap are aligned in the same plane.

11. The method as claimed in claim 10, further comprising the step of applying glue to the first bottom end flap and the first top end flap in the same motion.

12. An attachment for an apparatus for folding and filling a plurality of cartons erected from a plurality of collapsed carton tubes, each carton tube including (A) a receptacle portion including front, bottom, rear, and top panels foldably connected to each other in the order stated, (B) first and second bottom end flaps foldably connected to the bottom panel, and (C) first and second top end flaps foldably connected to the top panel, the front, bottom, rear, and top panels, second bottom end flap, and second top end flap cooperating to define an open receptacle portion with the first top end flap and first bottom end flap extending in spaced planes at times when the carton is erected, the attachment comprising:

end flap alignment means, including a generally U-shaped fork including a base and a plurality of rods each having a substantially linear portion connected to the base and a substantially angled portion connected to the linear portion, adapted to be attached to the apparatus for folding the first bottom end flap toward the open receptacle portion and folding the first top end flap away from the open receptacle portion in a single motion such that the first bottom end flap and the first to end flap are aligned in the same plane.

* * * * *

UNITED STATES PATENT AND TRADEMARK OFFICE

CERTIFICATE OF CORRECTION

PATENT NO. : 5,042,231

DATED : August 27, 1991

INVENTOR(S) : KONRAD et al.

It is certified that error appears in the above-identified patent and that said Letters Patent is hereby corrected as shown below:

Claim 2, col. 9, line 19, change "and" (1st. Occ.) to --end--.

Claim 4, col. 9, line 50, change "claim 1" to --claim 3--.

Claim 5, col. 9, line 57, after "end" insert --flap--.

Signed and Sealed this

Twelfth Day of January, 1993

*Attest:*

*Attesting Officer*

DOUGLAS B. COMER

*Acting Commissioner of Patents and Trademarks*